US005896949A

United States Patent [19]

Hamdy et al.

[11] Patent Number: 5,896,949

[45] Date of Patent: Apr. 27, 1999

[54] APPARATUS AND METHOD FOR THE DAMPING OF OSCILLATIONS IN AN ELEVATOR CAR

[75] Inventors: Ayman Hamdy, Zurich; Josef Husmann, Lucerne, both of Switzerland

[73] Assignee: Inventio AG, Hergiswil, Switzerland

[21] Appl. No.: 08/613,168

[22] Filed: Mar. 8, 1996

[30] Foreign Application Priority Data

Mar. 10, 1995 [CH] Switzerland ..... 694/95

[51] Int. Cl.[6] ..... B66B 1/34; B66B 7/04

[52] U.S. Cl. ..... 187/292; 187/409; 187/393

[58] Field of Search ..... 187/292, 393, 187/394, 409, 410

[56] References Cited

U.S. PATENT DOCUMENTS

| | | | |
|---|---|---|---|
| 5,027,925 | 7/1991 | Kahkipuro | 187/115 |
| 5,086,882 | 2/1992 | Sugahara et al. | 187/95 |
| 5,289,902 | 3/1994 | Fujita | 187/95 |
| 5,294,757 | 3/1994 | Skalski et al. | 187/115 |
| 5,304,751 | 4/1994 | Skalski et al. | 187/115 |
| 5,322,144 | 6/1994 | Skalski et al. | 187/115 |
| 5,535,853 | 7/1996 | Skalski | 187/410 |
| 5,544,721 | 8/1996 | Roberts | 187/394 |
| 5,597,988 | 1/1997 | Skalski | 187/393 |
| 5,652,414 | 7/1997 | Roberts et al. | 187/292 |

FOREIGN PATENT DOCUMENTS 0503972 9/1992 European Pat. Off. .

0641735 3/1995 European Pat. Off. .

OTHER PUBLICATIONS

International Search Report.

*Primary Examiner*—Robert E. Nappi

*Attorney, Agent, or Firm*—Greenblum & Bernstein, P.L.C.

[57] ABSTRACT

An apparatus and method are disclosed for reducing oscillations of an elevator car occurring transverse to the direction of travel. The elevator car is guided by rails and includes guide elements with a predefined range of motion. The apparatus includes a plurality of inertial sensors mounted to a frame of the elevator car and at least one actuator positioned between the elevator car and the guide elements. The inertial sensors measure oscillations transverse to the direction of travel and the at least one actuator is driven according to the output from the inertial sensors to actuate movement in an equal and opposite direction to the oscillations. The at least one actuator includes a drive motor with a stationary motor part coupled to the frame and a moving motor part coupled to the guide elements. The method includes measuring an oscillation occurring transverse to a direction travel and driving at least one actuator positioned between the car and the guide elements. The at least one actuator substantially effects movement in an equal and opposite direction to the oscillation. The command to the at least one actuator includes combining the outputs of an acceleration feedback controller active in the higher frequency range and a position feedback controller active in the lower frequency range to determine a force target value.

17 Claims, 8 Drawing Sheets

APPARATUS AND METHOD FOR THE DAMPING OF OSCILLATIONS IN AN ELEVATOR CAR

CROSS REFERENCE OF RELATED APPLICATIONS

The present invention is based upon Swiss Application No. 694/95-2 filed Mar. 10, 1995, the disclosure of which is incorporated herein by reference in its entirety.

BACKGROUND OF THE INVENTION

1. Field of the Invention

The invention concerns an apparatus and method for damping oscillations in an elevator car guided by rails. The system includes guide elements connected to the elevator that are movable between two end settings. Oscillations that occur transversely to the direction of travel may be measured by inertial sensors mounted at the elevator and used for driving at least one actuator positioned between the car and the guide elements. The at least one actuator operating simultaneously with the occurring oscillations and oppositely to the direction of the oscillations.

2. Discussion of the Background of the Invention and Material Information

Transverse oscillations act on the elevator during travel due to unevennesses in the guide rails and due to the slipstream, i.e., a consequence of the lateral components of traction forces transmitted by the traction cable or positional changes of the load during the travel and also due to aerodynamic forces. A method for damping such oscillations in an elevator or a part thereof was disclosed in U.S. Pat. No. 5,027,925. After it is determined that certain undesired transverse accelerations are occurring, corresponding counterforces are exerted on the elevator by a vibration damper positioned between the elevator and the frame. This method, however, requires an expensive floating bearing in the elevator frame, which in addition to the high apparatus expenditure entails a substantially greater space requirement. Further, the force acts on the frame, which, in the case of low frequencies, can cause a jerky, knocking swing of the frame between the guides. Such a system is hardly manageable in terms of regulation.

SUMMARY OF THE INVENTION

The present invention simplifies the method and apparatus for damping oscillations and for achieving satisfactory damping of different oscillations acting on the elevator at all times. This feature is addressed by at least one actuator equipped with a respective linear motor, a stationary motor part is fastened at the frame of the elevator and the moving motor part is fastened at the guide elements.

The respective linear motor for each actuator is particularly advantageous because these motors produce great dynamic and static forces and have low energy consumption. Moreover, they include a low weight and small moving masses and are relatively simple to control. Transverse acceleration may be exerted on the guide elements and transverse forces acting directly on the elevator may be reduced to the extent that they are no longer perceptible within the elevator. The equipment for oscillation damping may even by employed in elevators using asymmetric loading. In this case, the equipment readjusts itself automatically in response to the oblique positioning of the elevator relative to the guide rails so that an adequate damping travel stands at disposal towards both sides.

The cost of the apparatus for performing the method according to the present invention is low and the rapidly moving masses are very small. The low cost is also achieved by feeding all measurement signals to a common controller and acting on one actuator for each guide element. Further, structural resonances can be suppressed through adaption of the frequency response of the whole controlled system.

One particular advantage of the present invention is the position feedback for resetting the guide elements to the mid-position, which is active only at low frequencies.

Accordingly, the present invention is directed to an apparatus for reducing oscillations of an elevator car, the elevator car guided by rails and including guide elements with a predefined range of motion. The apparatus includes a plurality of inertial sensors mounted to a frame of the elevator car and at least one actuator positioned between the elevator car and the guide elements. The inertial sensors measure oscillations transverse to the direction of travel and the at least one actuator is driven according to the output of these sensors in an equal and opposite direction to the oscillations. The at least one actuator includes a drive motor with a stationary motor part coupled to the frame and a moving motor part coupled to the guide elements.

According to another aspect of the present invention, the moving motor part includes a magnet.

According to a further aspect of the present invention, the guide element includes a roller lever, the moving motor part being coupled to the roller lever.

According to yet another aspect of the present invention, the guide element includes a roller lever, the moving motor part being coupled to the roller lever through a tension-compression member.

According to another aspect of the present invention, the drive motor further includes an air gap between the stationary motor part and the moving motor part. The air gap is maintained by a low friction guide means.

According to another aspect of the present invention, the drive motor includes a linear motor.

The present invention is also directed to an apparatus for reducing oscillations of an elevator car, the elevator car guided by rails and including guide elements with a predefined range of motion. The apparatus includes a plurality of inertial sensors mounted to a frame of the elevator car and at least one actuator positioned between the elevator car and the guide elements. The inertial sensors measure oscillations transverse to the direction of travel and the at least one actuator is driven according to the output of the inertial sensors for actuating movement in an equal and opposite direction to the oscillations. The at least one actuator includes a drive motor with a rotary drive.

According to another aspect of the present invention, the rotary drive includes a moving motor part coupled to the guide elements through a crank and a tension-compression member.

According to a further aspect of the present invention, the rotary drive includes a moving motor part coupled to the guide elements through a cam plate.

According to a further aspect of the present invention, the rotary drive includes a moving motor part coupled to the guide elements through a flexible tension means.

The present invention is also directed to a method for reducing oscillations of an elevator car, the elevator car guided by rails and including guide elements with a predefined range of motion. The method includes measuring an oscillation occurring transverse to the direction of travel and driving at least one actuator positioned between the car and the guide elements, for substantially effecting movement in an equal and opposite direction to the oscillation. The actuator includes a drive motor. The command for the at least one actuator combines the outputs of a plurality of controllers to determine a force target value.

According to yet another aspect of the present invention, the plurality of controllers including an acceleration feedback controller active at higher frequencies and a position feedback controller active at lower frequencies.

According to yet another aspect of the present invention, the method further includes moving the guide elements in response to the measured oscillation, the motion which minimizes an actual oscillation of the car and guides the guide element from a displaced position slowly to the mid-position. The moving step includes defining a mid-position for the guide elements within the predetermined range of motion.

According to still another aspect of the present invention, the method further includes effecting an acceleration feedback for the higher frequencies and a position feedback for the lower frequencies according to a first and second control loops. The first control loop including the acceleration feedback controller active at higher frequencies and the second control loop including the position feedback controller active at lower frequencies and the controller hardware including a computer program executed by a digital signal processor.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
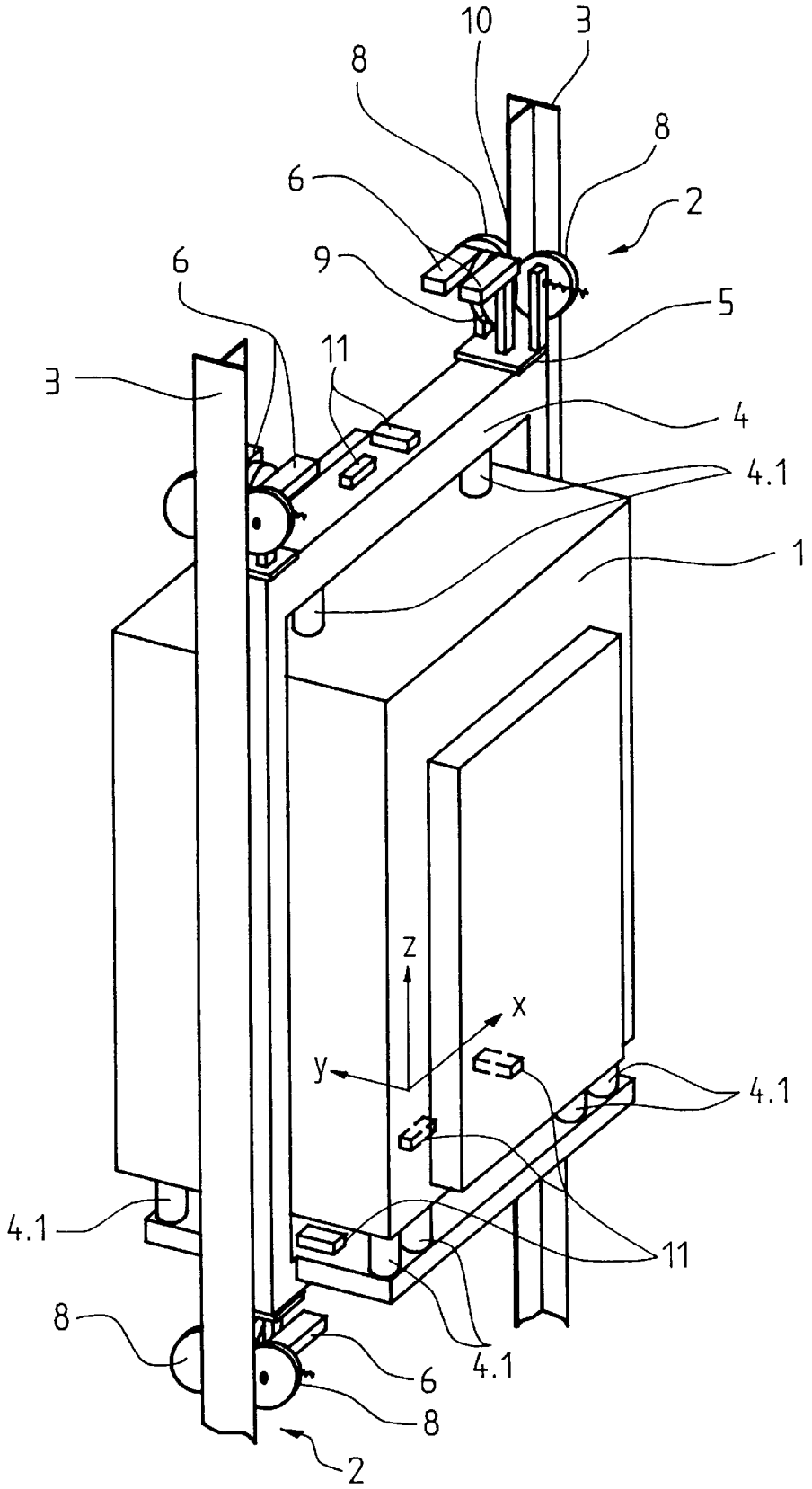
FIG. 1 is a schematic illustration of an elevator car guided by rails.

FIG. 1 is a schematic illustration of elevator equipment according to the invention. An elevator car 1 is guided by roller guides 2 on rails 3 and mounted in a shaft (not shown). Car 1 is carried elastically in a car frame 4 for passive oscillation damping. The passive oscillation damping is performed by rubber springs 4.1, which are designed to be relatively stiff in order to suppress the occurrence of low-frequency rotary oscillations about the y axis. The roller guides 2 are laterally mounted above and below car frame 4 by a post 5, actuators 6, guide elements in the shape of two lateral rollers 8, and a middle roller 9, positioned 90° from lateral rollers 8.

Unevennesses in rails 3, lateral components of traction forces originated from the traction cables, positional changes of the load during travel and aerodynamic forces cause oscillations of car frame 4 and car 1, and thus impair travel comfort. Such oscillations of the car 1 are to be reduced. Two position sensors 10 per roller guide 2 measure the respective spacing of car 1 from rail 3. Three or five inertial sensors 11 measure transverse oscillations or accelerations acting on car 1. Inertial sensors 11 are preferably arranged such that one sensor is positioned on the axis through the center of mass of frame 4 and the other sensors are positioned spaced far apart from each other (in pairs if five sensors are used) in order to detect rotations about the z axis. Further, shocks produced by wind and cable forces are also detectable.

Actuators 6, positioned at each roller guide 2, are simultaneously operable in response to occurring oscillations in a direction opposite the oscillations and controlled by processing the measured oscillations or accelerations. Thereby, damping of the oscillations acting on car 1 is achieved. Oscillations are reduced to the extent that the oscillations are imperceptible to the elevator passenger. Each roller guide 2 is equipped with two actuators 6. Thereby, five degrees of freedom or axes of the car 1 can be controlled: displacement in y and x direction and rotation about the x, y and z axes.

Alternatively, only the two lower roller guides 2 may be equipped with the respective actuators 6. Thus, three degrees of freedom in one plane or three axes may be controlled: displacement in x and in y direction and rotation about the z axis (according to the coordinate system in FIG. 1).

Figure 2:
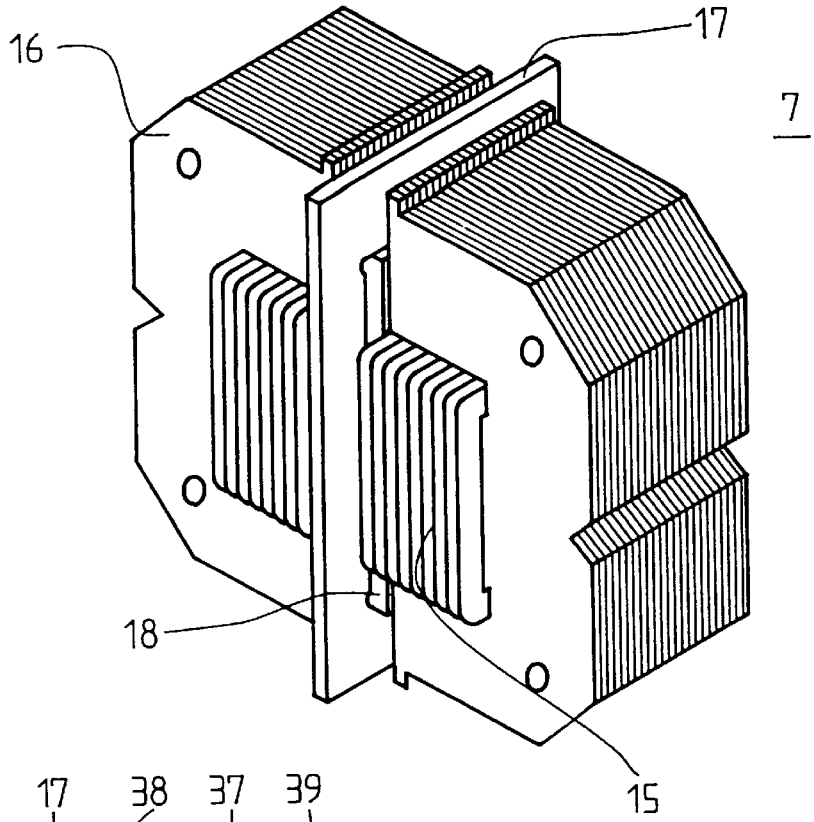
FIG. 2 is an actuator constructed as a linear motor.

FIG. 2 shows a linear motor 7 of actuator 6 according to the present invention. Linear motor 7 is based on the principle of a moving magnet and comprises a laminated stator 16, windings 15, and a moving motor part 17 constructed as a magnet. A magnet 18 is mounted at moving motor part 17. Linear motor 7 has the advantage of simple controllability, low weight and small moving masses, and great dynamic and static force (e.g., 800 newtons) for small energy consumption.

Figure 4:
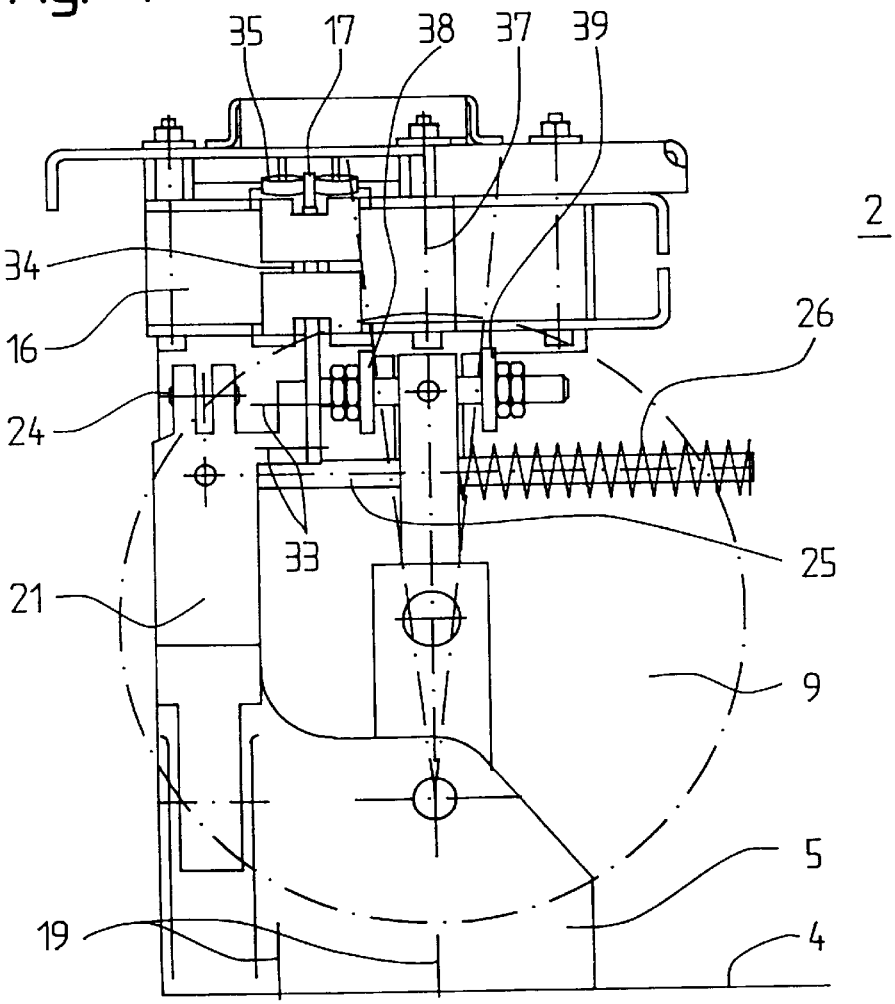
FIG. 4 is a side elevation view of a roller guide.
Figure 3:
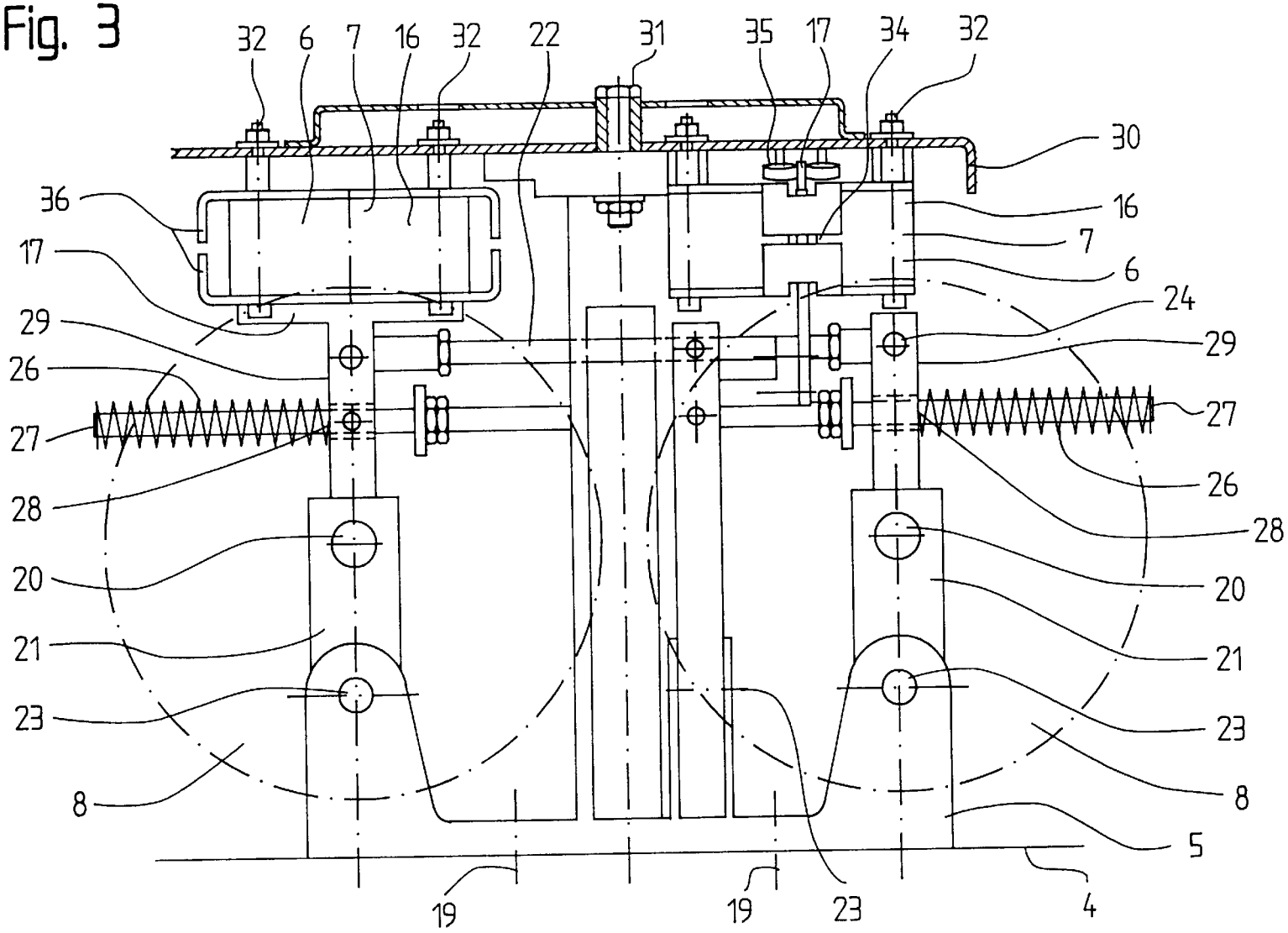
FIG. 3 is a front elevation view of a roller guide.

FIGS. 3 and 4 show a roller guide according to the present invention. The post 5 is fastened at car frame 4 by fastening elements 19. Each roller guide 2 is equipped with two actuators 6, each actuator is equipped with a respective linear motor 7. One linear motor 7 drives the middle roller 9 and the other linear motor 7 drives both lateral rollers 8. The rollers 8 and 9 are fastened by means of axle pins 20 at roller levers 21. The roller levers 21 of both lateral rollers 8 are connected through a tie rod 22. For the transmission of the movements emanating from the actuators 6, either the roller levers 21 are connected with the post 5 through a low friction joint by axle pins 23 or the roller levers 21 of both lateral rollers 8 are connected by tie rod 22 through a low friction joint by axle pins 24. Guide rods 25 with contact pressure springs 26 are mounted at the posts 5. The contact pressure springs 26 are each time fixed at the outer end 27 of the guide rods 25. The guide rods 25 extend through a passage 28 in the roller levers 21 so that the contact pressure springs 26 bear on the outward sides 29 of the roller levers 21 and urge the rollers 8 and 9 against the guide rail 3.

A fastening plate 30 is mounted at the post 5 by fastening elements 31, such as screws. The stators 16 of the actuators 6 are screwed to the fastening plate 30 by fastening elements 32. The moving motor part 17 is connected by screws 33 at the roller lever 21 and thus with the rollers 8 and 9. In order that the air gap 34 of the linear motor 7 remains maintained, a lateral guide is still required. The lateral guide comprises ball-bearing rollers 35 which are almost frictionless. Two brackets 36 enable mounting of the ball-bearing rollers 35 and form the lateral boundaries of the moving motor part 17. A low-friction bearing is necessary in order to be able to control the force to be produced by actuator 6 accurately. The length of the stator 16 of the linear motor 7 determines the maximum possible inner and outer end settings starting out from a mid-setting 37. The travel limitation takes place through elastic abutments 38 and 39.

Alternatively, moving motor part 17 may be connected with roller lever 21 through a tension-compression member. The bearing of the moving motor part 17 then takes place independently of the roller lever 21.

Due to the parallel connection of contact pressure spring 26 with actuator 7, roller guide 2 remains capable of operating even after a partial or complete failure of the active oscillation damping because contact pressure springs 26 urge rollers 8 and 9 against guide rail 3 independently of actuator 6.

Figure 5A:
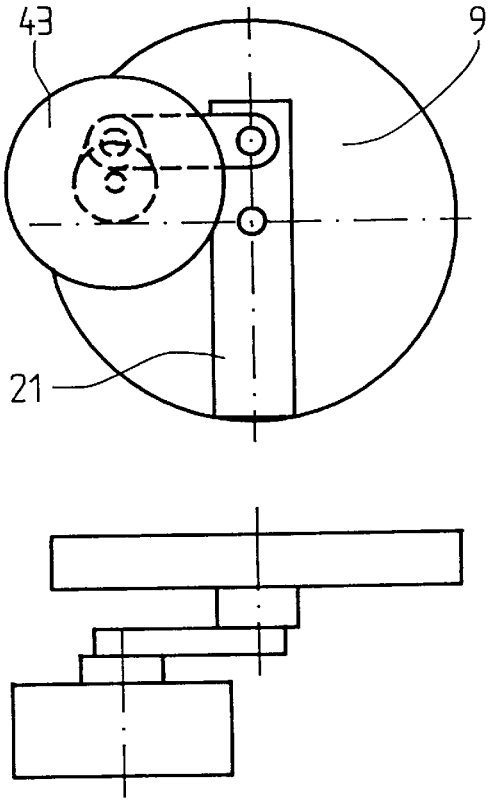
FIGS. 5*a, b* and *c* are three variations of a rotary drive for the actuator.
Figure 5B:
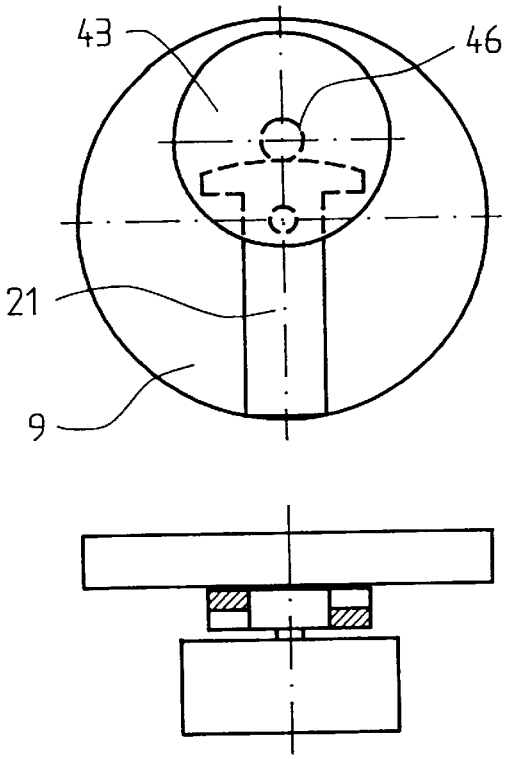
Figure 5C:
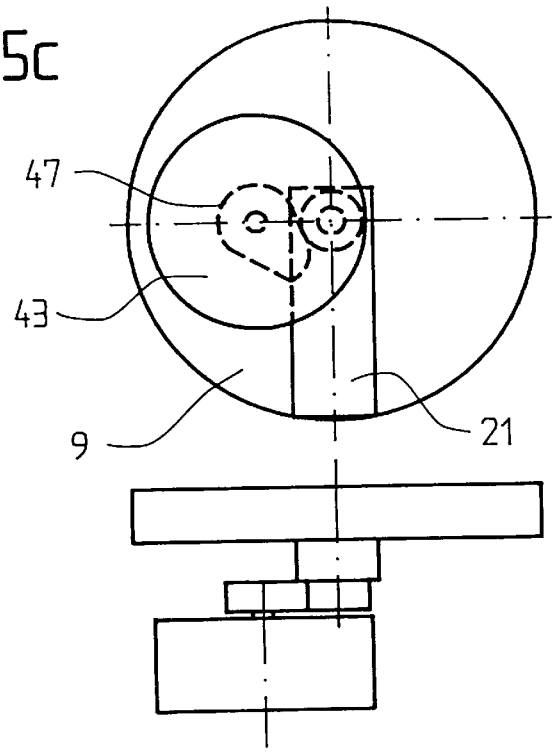

FIGS. 5*a*, 5*b* and 5*c* show alternative drives using a rotary drive 43 in place of linear motor 7. This drive includes a pivot angle of about 90 degrees and drives roller lever 21 by a crank 44 and a tension-compression member 45 (FIG. 5*a*) or a flexible traction means 46 (FIG. 5*b*) or by a cam disc 47 (FIG. 5*c*).

Figure 6A:
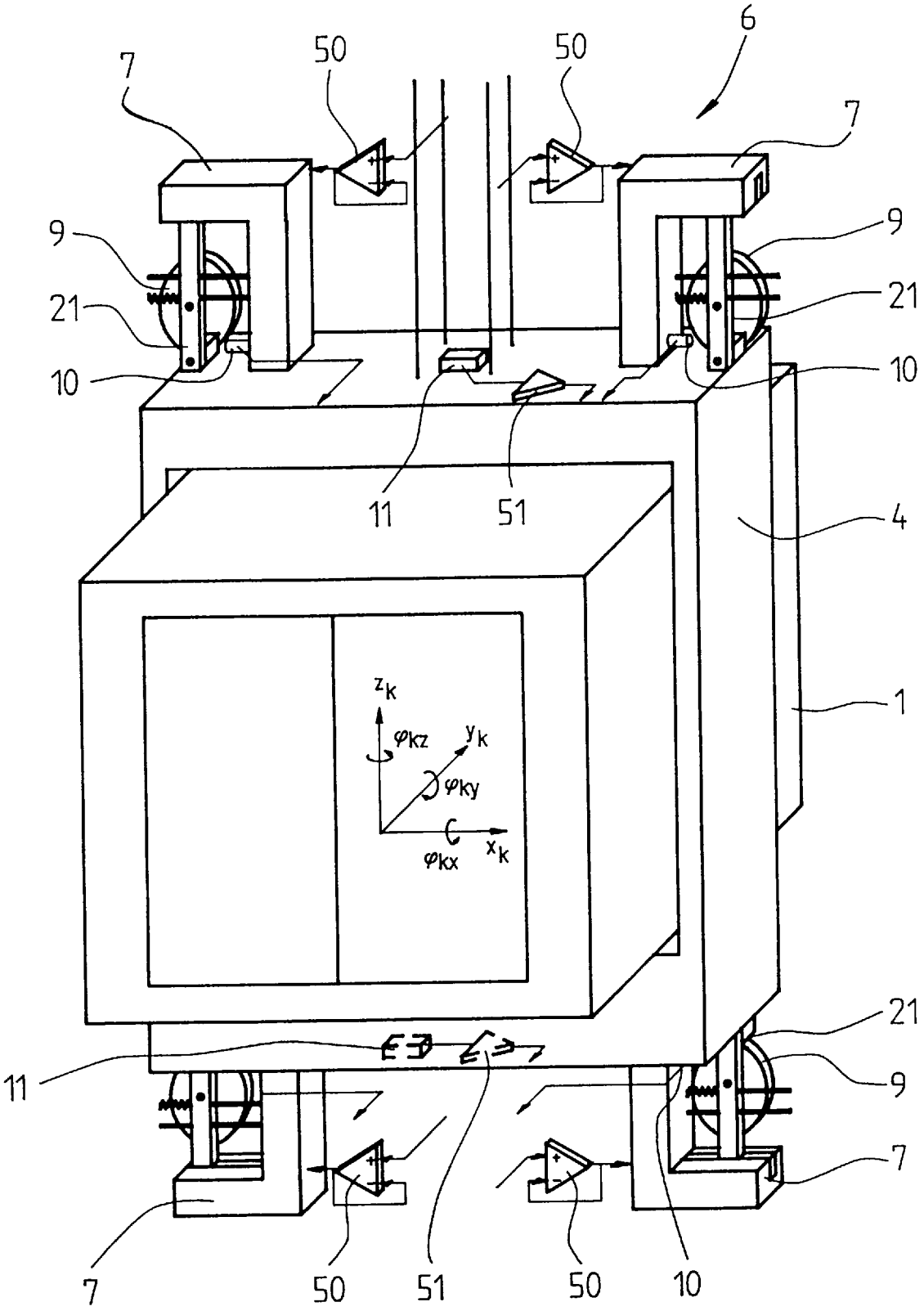
FIG. 6*a* is a schematic illustration of an elevator with actuators and sensors in an $X_k$ direction.
Figure 6B:
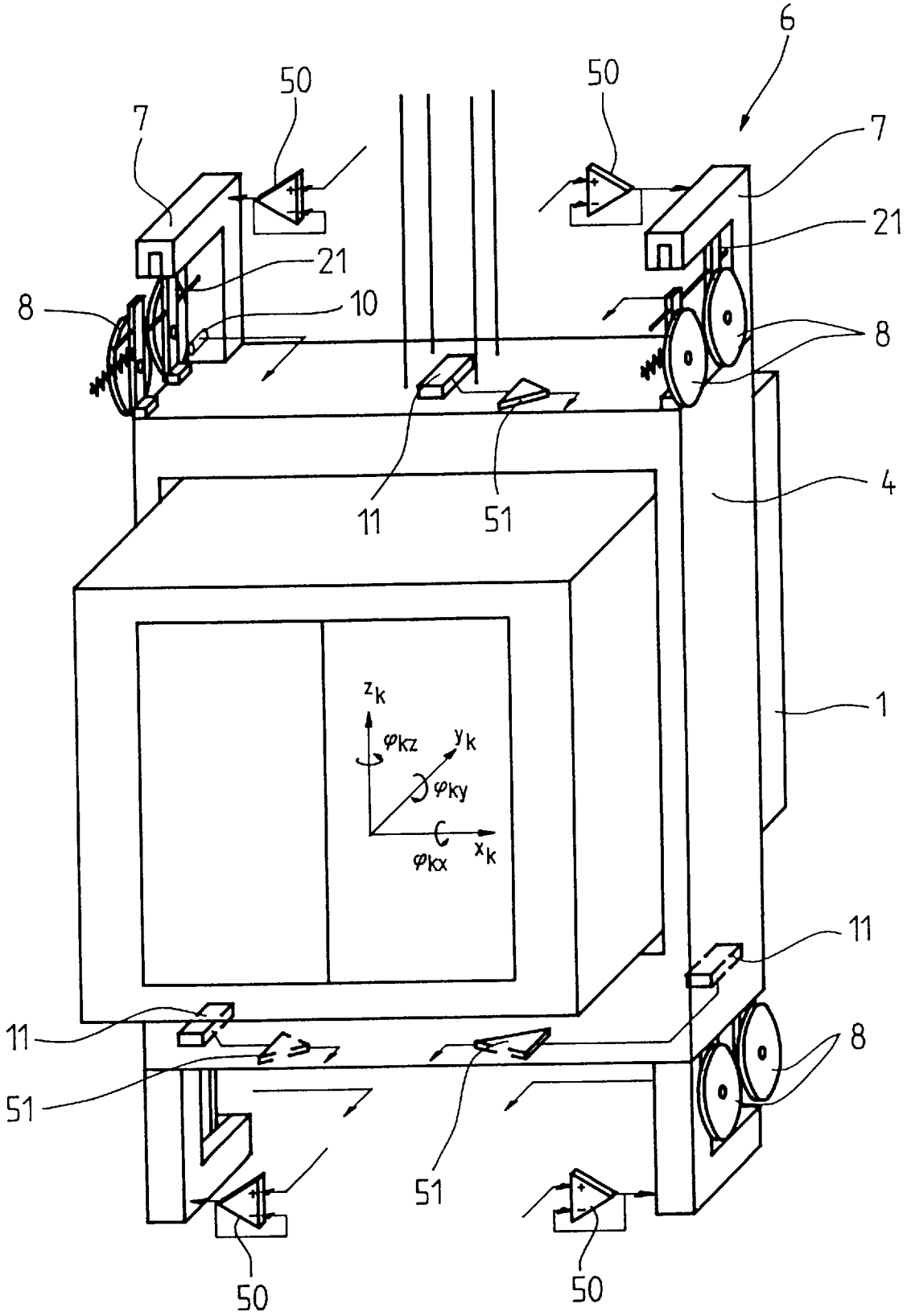
FIG. 6*b* is a schematic illustration of an elevator with actuators and sensors in a $y_k$ direction.

FIGS. 6*a* and 6*b* show an elevator car 1 with actuators and sensors in an $x_k$ direction or in a $y_k$ direction according to the apparatus of the present invention. For simplification of the illustration, the $x_k$ and the $y_k$ directions are each illustrated separately.

Control for suppressing car oscillations and for correcting the positioning of car 1 relative to the two guide rails 3 is based on a dynamic model of the system. This model is a mathematical description which combines all present practical and theoretically experiences with the system. Car oscillations which are to be damped by this equipment occur in the following degrees of motion:

displacement $x_k$ in $x_k$ direction;

rotation $\phi_{ky}$ about the $Y_k$ axis;

displacement $y_k$ in $y_k$ direction;

rotation $\phi_{kx}$ about the $x_k$ axis; and rotation $\phi_{kz}$ about the $z_k$ axis.

The system model describes the dynamics of the elevator system in all degrees of freedom mentioned above. This model also takes into account all relative structural resonances which arise due to the elasticities between the different masses and which arise within the car frame 4.

Based on the system model, a controller is used which monitors all degrees of freedom described from the model at the same time. For this purpose, the methods of the robust multivariable control are used (multi-input, multi-output or MIMO Robust Design). These methods use the system model that is present in order to design a controller based on an observer. The observer is a dynamic part of the controller with the task of calculating all movement states not directly measured (e.g., speeds and positions of the different masses) in real time on the basis of the available measurements (e.g., acceleration at different measurement points). Thus, the controller will have a maximum of information data about the system available to it. Based on all movement states (both measured and calculated), the controller supplies the best command for each degree of freedom, which substantially improves the quality of the control. Since the model (and the observer based thereon) takes all relevant structural resonances into account, the controller does not excite any of these resonances. The model-based controller design takes care of the necessary stability of the system. This would not be the case if system dynamics were not taken into consideration in the controller design.

The robust controller is designed to be effective in only a certain predetermined frequency range so as not to react to undesired frequency-dependent system dynamics and disturbances. The present invention accomplishes this feature without having to connect additional filters to the controller.

Additional filters can restrict the effectiveness of the regulator and lead to instability. They also substantially increase the computing effort of the control algorithm. A further advantage of the robust design method is the consideration of the model uncertainties during the design. Inaccuracies of the model are quantified as frequency-dependent magnitudes and taken into consideration in the controller design. Thus, the resultant controller possesses sufficient robustness against possible disturbances and modelling errors.

The first target of the controller is the suppression of car oscillations in the higher frequency range (between 0.9 and 15 Hz) without adversely affecting performance of the controlled elevator outside this range any more than an uncontrolled elevator. On the other hand, the controller must take care that the setting of car frame 4, relative to guide rails 3, is so controlled that it gives a sufficient damping travel at each roller 8 and 9. This is particularly important when car 1 is asymmetrically loaded. For the first object of the control, an acceleration feedback or a speed feedback by inertial sensors 11 should suffice. A position feedback is necessary for the second object of the control. If the absolute position of car 1 could be measured and fed back for the control, the second feedback would not conflict with the first one. Since only measurements of the relative positions between rollers 9 and car frame 4 are available, the absolute position of car 1 cannot be measured, rather, only the position of frame 4 relative to guide rails 3. The position feedback should keep the plays constant between frame 4 and roller lever 21, which is nothing more than following the unevennesses of the rails. For this reason, the two feedbacks have conflicting objects. In order to avoid the conflict between acceleration (or speed) and position feedbacks, the following strategy is followed:

Two controllers are used for the production of a common output signal. The first controller is concerned with the measurements from inertial sensors 11 and therefore is responsible for the suppression of oscillations. The second controller is concerned with the position measurements and is responsible for the guide plays of car 1. The target values of the forces which the first controller demands of the actuators 6 are added to the corresponding magnitudes of the second controller. The solution for avoidance of conflict between both controllers is based on the circumstance that the forces (asymmetrical loading of the car, a great lateral cable force, etc.), which are responsible for the oblique position of car 1, change substantially more slowly than the other disturbance sources which cause car oscillations (mainly rail unevennesses and air disturbance forces). For this reason, position control, which is more likely to be harmful to the suppression of the oscillations, is limited to 0 to 0.7 Hz. Accordingly, no adverse influence on the suppression of the oscillations is present because disturbances are to be suppressed above 0.9 Hz. The feedback of the signals from inertial sensors 11 must not be effective in the frequency range below 0.9 Hz. Thus, the sensor zero error and, in the case of an acceleration sensor, the measured part of the gravitation (which is not constant because of the tilting movement) has no influence on the position control. Thereby, the danger of a saturation of the actuators 6 is also reduced. For this reason, the limited bandwidth of each feedback loop by the robust design method is particularly important.

A further advantage of the present invention lies in that the controller contains no non-linearity. A non-linearity makes the stability analysis very difficult, if at all possible. Since the two return movements are designed at the same time, the method takes both control loops into consideration during the stability analysis.

The mounting of inertial sensors 11 on car frame 4 instead of on car body 1 or on roller guides 2 is particularly advantageous for an efficient control. If the sensors were to be mounted on car body 1, the measurements would display appreciable phase losses due to the elastic suspension of car 1. Far higher oscillation amplitudes occur at the roller guides and the influence of gravity would have to be compensated for.

The controllers are designed for the system in the car coordinate system. The measurements are imaged from the coordinate system of each sensor to the car body coordinate system with the aid of different linear transformations. Another transformation from car coordinate system to the actuator coordinate system is necessary for the output of the force target values.

The active system for the damping of car oscillations and for the setting correction of car 1 in five degrees of freedom ($x_k$, $\phi_{ky}$, $y_k$, $\phi_{kx}$, $\phi_{kz}$) consists of the following elements:

Eight linear motors 7 or rotary drives 43;

Eight amplifiers and force controllers 50 for the linear motors 7 or rotary drives 43;

Five inertial sensors 11 (acceleration or speed pick-ups);

Five voltage/current converters 51 for the outputs of the inertial sensors 11; and Eight position sensors 10.

In an alternative version of the active system, only three degrees of freedom of the car are regulated ($x_k$, $y_k$, $\phi_z$). For that reason, linear motors 7 and sensors 10 and 11 are only mounted below the car. The computing effort is substantially reduced, which enables the application of a slow real time computer, which presents certain cost benefits beside the reduction of the number of actuators and sensors.

Figure 7:
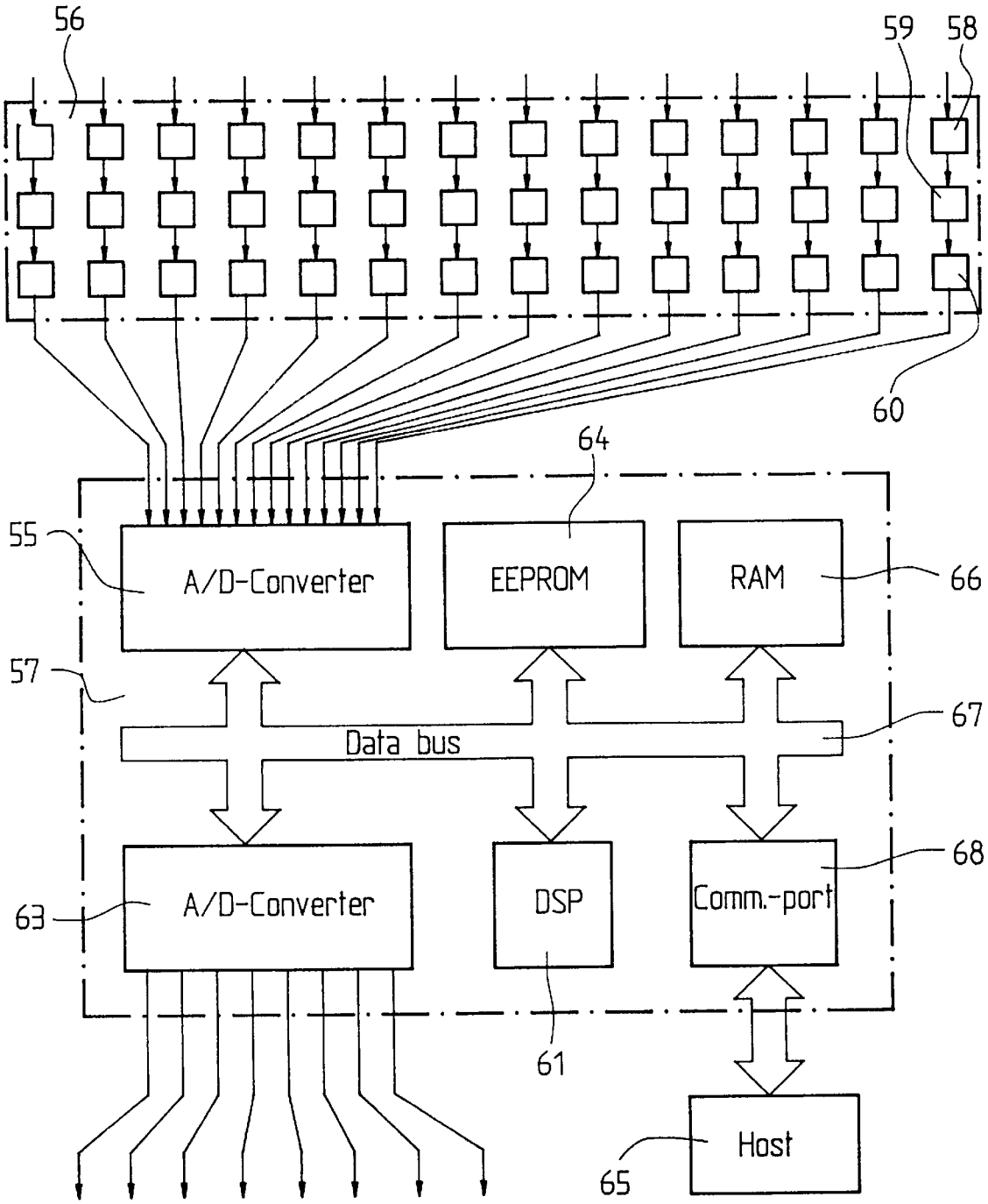
FIG. 7 is the controller part of an active system.

FIG. 7 shows the controller part of the active system according to the present invention. Since the spacings between the sensors and an analog-to-digital converter unit 55 are relatively long, the measurement signals must be transmitted as current signals, not as voltage signals. Position sensors 10 already deliver their output signals as current. Conversely, inertial sensors 11 deliver their outputs in the form of voltage signals. Thus, a voltage-to-current converter 51 becomes necessary for the output of each inertial sensor 11 (see FIGS. 6*a* and 6*b*). Since the analog-to-digital converters 55 can sample voltage signals, an analog signal processing unit 56 with one channel for each measurement signal is used on the part of the real time computer 57. Each channel comprises a current-to-voltage converter 58, an anti-aliasing low-pass filter 59, necessary for the sampling, and a conventional voltage amplifier 60 for matching the signal range.

The core of the real time computer 57 is represented by the digital signal processor 61, which is responsible for all mathematical computations. A multichannel analog-to-digital converter unit 55 is used to be able to detect the necessary measurements from the hardware. A multichannel digital-to-analog converter unit 63 is utilized for the delivery of the force target values to the linear motors 7. The entire controller algorithm with all necessary programs is stored in EEPROM 64. This algorithm and program are supplied by a host computer 65 during a start-up of the active system and matched to car 1 to be controlled. After the start-up, the host computer 65 is disconnected, while the algorithm and programs are stored in the EEPROM 64 until modified or replaced by host computer 65 during recalibration. RAM 66 is used by the digital signal processor 61 as a storage device for intermediate values during computations. A data bus 67 is used for communication between the digital signal processor 61 and all other components. A module responsible for the connection with the host computer, e.g., a communication port 68, is also connected to data bus 67.

The possibility of dividing the computing task between two digital signal processors 61, connected to the same data bus 67, is possible in the event the problem cannot be solved quickly enough by a single signal processor 61.

Figure 8:
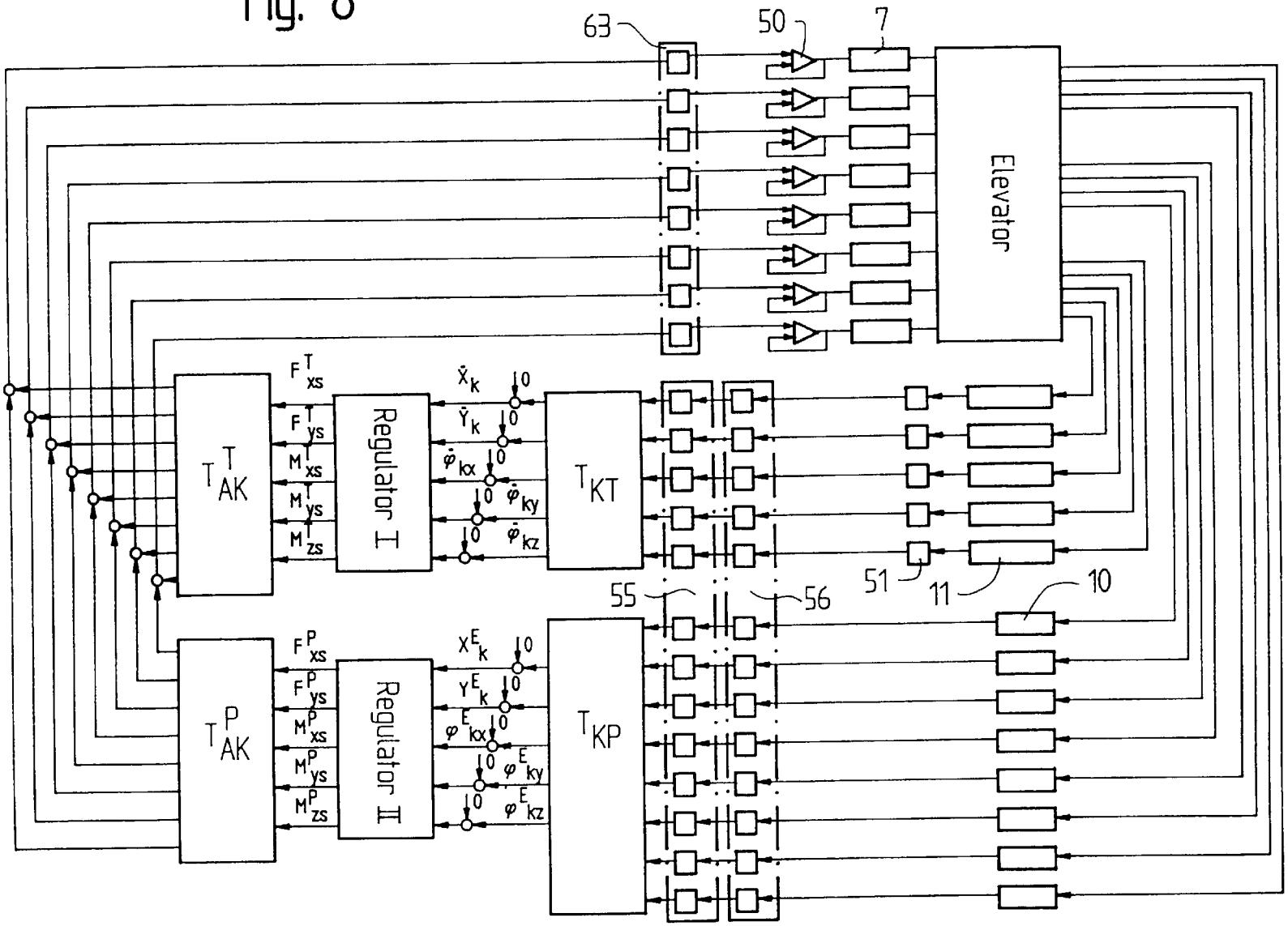
FIG. 8 is a block diagram for the entire system.

FIG. 8 shows the block diagram for the entire system according to the present invention. The real time computer 57 is programmed to execute the control algorithm at a certain frequency in real time.

The algorithm comprises the following steps which need not necessarily be executed in the stated sequence:

1. Inertial Sensors

Processing the measurements from the five inertial sensors 11 on car frame 4 in the $x_k$ and $y_k$ directions. Converting the measured signals in voltage-to-current converters 51, transmitting the converted signals through the analog signal-processing unit 56, and sampling the processed signals by the analog-to-digital converter channels 55. These above-mentioned measurements are present in the coordinate systems of the inertial sensors 11 and, since the control occurs in the car coordinate system, the measurements must be transformed into the car coordinate system. For this purpose, the algorithm uses a linear transformation $T_{KT}$. The outputs of this transformation are:

Translational acceleration (or translational speed) of car 1 in the $x_k$ direction ($\ddot{x}_k$ or $\dot{x}_k$).

Rotational acceleration (or rotational speed) of car 1 about the $y_k$ axis ($\phi_{ky}$ or $\dot{\phi}_{ky}$).

Translational acceleration (or translational speed) of car 1 in the $y_k$ direction ($\ddot{y}_k$ or $\dot{y}_k$).

Rotational acceleration (or rotational speed) of car 1 about the $x_k$ axis ($\phi_{kx}$ or $\dot{\phi}_{kx}$).

Rotational acceleration (or rotational speed) of car 1 about the $z_k$ axis ($\phi_{kz}$ or $\dot{\phi}_{kz}$).

The target value (magnitude) of each of these accelerations (or speeds) is zero. Therefore, the five transformed signals are subtracted from zero before they are input to the robust multivariable controller I. This controller I simultaneously reacts to the five transformed signals according to the concept described above and supplies the following signals at its output:

A force target value $F^T_{xs}$ in the $x_k$ direction,

A torque target value $M^T_{ys}$ about the $y_k$ axis,

A force target value $F^T_{ys}$ in the $y_k$ direction,

A torque target value $M^T_{xs}$ about the $x_k$ axis, and

A torque target value $M^T_{zs}$ about the $z_k$ axis.

The target values from the controller I are transformed into the actuator coordinate systems with the aid of a linear transformation $T^T_{AK}$.

2. Position Sensors

Reading the measurements from position sensors 10 in the $x_k$ direction and in the $y_k$ direction. The measured signals are transmitted through the analog signal-processing unit 56 and the processed signals are sampled by analog-to-digital converter channels 55. Since the above-mentioned measurements are present in the position sensor coordinate system, they must be transformed into the car coordinate system by a linear transformation $T_{KP}$. This transformation supplies five position output signals. To obtain position error signals, each of the output signal is subtracted from zero. Thus, two translational position error signals ($x^E_K$ and $y^E_k$) and three rotational position error signals ($\phi^E_{Kx}$, $\phi^E_{Xy}$ and $\phi^E_{Kz}$) are obtained.

A robust multivariable controller II, according to the aforementioned design, reacts to the five position errors and supplies the following output target values for correction of the elevator position:

The force target value $F^P_{xs}$ for displacement in the $x_k$ direction,

The torque target value $M^P_{ys}$ for rotation about the $y_k$ axis,

The force target value $F^P_{ys}$ for displacement in the $Y_k$ direction,

The torque target value $M^P_{xs}$ for rotation about the $x_k$ axis, and

The torque target value $M^P_{zs}$ for rotation about the $z_k$ axis.

The target values from controller II are transformed into the actuator coordinate system with the aid of the linear transformation $T^P_{AK}$. The difference between linear transformations $T^T_{AK}$ and $T^P_{AK}$ is that the force target values from the $T^P_{AK}$ transformation of linear motors 7 only exert compression forces on the rails 3 in the $x_k$ direction. This compression is achieved by controller II simultaneously actuating one actuator below the car in the $x_k$ direction and another actuator above the car in the $x_k$ direction. Thus, the four rollers 9 never lose contact with guide rails 3 in the $x_k$ direction. This was not possible after the $T^T_{AK}$ transformation, because it demands substantially lower forces than the $T^P_{AK}$ transformation.

3. After Transformation

The corresponding outputs of the two transformations $T^T_{AK}$ and $T^P_{AK}$ are added together to compute the force target values for each of the eight linear motors 7.

The force target values are converted into analog signals by the digital-to-analog converter channels 63. The converted signals drive the corresponding power amplifiers and force controllers 50, which control the currents of the linear motors 7 by analog feedback. Power amplifiers 50 are pulse width modulated. Car frame 4 is now so influenced by the resultant forces that the two objects of control are achieved. Should the respective force target values assume the value of zero (in case of trouble-free travel), then the associated actuator exerts no forces.

The execution of all linear transformations as well as the computation of the control algorithm is performed by the digital signal processor 61 in each sampling period.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. An apparatus for reducing oscillations of an elevator car, the elevator car guided by rails and including guide elements with a predefined range of motion, said apparatus comprising:

a plurality of inertial sensors mounted to a frame of the elevator car, said inertial sensors measuring oscillations transverse to the direction of travel;

at least one actuator positioned between the elevator car and the guide elements and driven according to the output from said inertial sensors, said at least one actuator, for actuating movement in an equal and opposite direction to the oscillations, comprising a drive motor; and said drive motor comprising a linear motor having a stationary motor part coupled to the frame and a moving motor part coupled to the guide elements;

the moving motor part having a low weight and small moving masses, having a fixed air gap to the stationary motor part, and having a direction of movement perpendicular to an axis of a winding of the linear motor, wherein only one actuator is associated with each guide element.

2. The apparatus according to claim 1, said moving motor part comprising a magnet.

3. The apparatus according to claim 1, the guide element comprising a roller lever, said moving motor part being coupled to said roller lever.

4. The apparatus according to claim 1, the guide element comprising a roller lever, said moving motor part being coupled to said roller lever through a tension-compression member.

5. The apparatus according to claim 1, said air gap being maintained by a low friction guide element.

6. An apparatus for reducing oscillations of an elevator car, the elevator car guided by rails and including guide elements with a predefined range of motion, said apparatus comprising:

a plurality of inertial sensors mounted to a frame of the elevator car, said inertial sensors measuring oscillations transverse to the direction of travel;

at least one actuator positioned between the elevator car and the guide elements and driven according to output from said inertial sensors, said at least one actuator, for actuating movement in an equal and opposite direction to the oscillations, comprising a drive motor; and said drive motor comprising a rotary drive, wherein only one actuator is associated with each guide element.

7. The apparatus according to claim 6, said rotary drive comprising a moving motor part coupled to the guide elements through a crank and a tension-compression member.

8. The apparatus according to claim 6, said rotary drive comprising a moving motor part coupled to the guide elements through a cam plate.

9. The apparatus according to claim 6, said rotary drive comprising a moving motor part coupled to the guide elements through a flexible tension means.

10. A method for reducing oscillations of an elevator car, the elevator car guided by rails and including guide elements with a predefined range of motion, said method comprising:

measuring an oscillation occurring transverse to the direction of travel; and controlling at least one actuator positioned between the car and the guide elements, the at least one actuator, for effecting movement in an equal and opposite direction to the oscillation, including a drive motor;

the control of the at least one actuator comprising combining outputs of a plurality of controllers to determine a force target value acting on one actuator for each guide element and based upon a flexible body dynamic model that takes into account relevant structural resonances.

11. The method according to claim 10, said plurality of controllers comprising an acceleration feedback controller active in the higher frequency range and a position feedback controller active in the lower frequency range.

12. The method according to claim 11, further comprising moving the guide elements in response to the measured oscillation, the moving minimizing an actual oscillation of the car;

the moving of the guide elements comprising defining a mid-position for the guide elements within the predetermined range of motion; and guiding the guide elements from a displaced position in the low frequency range to the mid-position.

13. The method according to claim 11, further comprising effecting an acceleration feedback active at higher frequencies and a position feedback active at low frequencies according to a first and a second control loops, the first control loop including said acceleration feedback controller active in the higher frequency range and the second control loop including said position feedback controller active in the lower frequency range; and said controller comprising a computer program.

14. The method according to claim 13, said computer program executed by a digital signal processor.

15. The apparatus according to claim 1, further comprising:

at least one position sensor;

a position feedback controller generating position feedback control signals;

an acceleration feedback controller generating acceleration feedback control signals;

an actuator controller that determines a force target value for each actuator from the position feedback control signals and the acceleration feedback control signals; and each actuator acting on a respective guide element in accordance with the determined force target value.

16. The apparatus according to claim 6, further comprising:

at least one position sensor;

a position feedback controller generating a position feedback control signals;

an acceleration feedback controller generating an acceleration feedback control signals;

an actuator controller that determines a force target value for each actuator from the position feedback control signals and the acceleration feedback control signals; and each actuator acting on a respective guide element in accordance with the determined force target value.

17. An apparatus for reducing oscillations of an elevator car, the elevator car guided by rails and including guide elements with a predefined range of motion, said apparatus comprising:

a plurality of inertial sensors mounted to a frame of the elevator car, said inertial sensors measuring oscillations transverse to the direction of travel;

at least one actuator positioned between the elevator car and the guide elements and driven according to output from said inertial sensors, said at least one actuator, for actuating movement in an equal and opposite direction to the oscillations, comprising a drive motor; and said drive motor comprising a rotary drive having a motor part coupled to the guide elements through a cam plate.

* * * * *